United States Patent [19]

Yoshiyasu et al.

[11] 4,409,445

[45] Oct. 11, 1983

[54] CIRCUIT BREAKER

[75] Inventors: Hajimu Yoshiyasu, Itami; Fumiyuki Hisatsune, Fukuyama; Shinji Yamagata, Fukuyama; Junichi Terachi, Fukuyama, all of Japan

[73] Assignee: Mitsubishi Denki Kabushiki Kaisha, Tokyo, Japan

[21] Appl. No.: 326,678

[22] Filed: Dec. 1, 1981

[30] Foreign Application Priority Data

| | | | |
|---|---|---|---|
| Dec. 9, 1980 | [JP] | Japan | 55-175984 |
| Feb. 26, 1981 | [JP] | Japan | 56-27913[U] |
| Feb. 26, 1981 | [JP] | Japan | 56-27920[U] |
| Feb. 26, 1981 | [JP] | Japan | 56-27922[U] |
| Feb. 26, 1981 | [JP] | Japan | 56-27923[U] |

[51] Int. Cl.[3] ..... H01H 33/02

[52] U.S. Cl. ..... 200/144 R; 200/144 C; 200/149 R

[58] Field of Search ..... 200/144 R, 149 R, 149 A, 200/144 C

[56] References Cited

U.S. PATENT DOCUMENTS

| | | | |
|---|---|---|---|
| 3,402,273 | 9/1968 | Davis | 200/144 R |
| 3,599,130 | 8/1971 | Murai et al. | 200/144 R |

FOREIGN PATENT DOCUMENTS

| | | | |
|---|---|---|---|
| 1765051 | 7/1971 | Fed. Rep. of Germany | 200/144 R |

*Primary Examiner*—Robert S. Macon

*Attorney, Agent, or Firm*—Wenderoth, Lind & Ponack

[57] ABSTRACT

This invention provides a novel circuit breaker which is good in terms of both its current-limiting performance and its interrupting performance. The contactors of the circuit breaker for opening and closing an electric circuit are provided with arc shields of a high resistivity material, disposed in a manner to surround the contacts thereof, and arc runways of higher conductivity than the arc shields, and of predetermined dimensions and directions are further provided adjacent to the contacts.

9 Claims, 23 Drawing Figures

CIRCUIT BREAKER

BACKGROUND OF THE INVENTION

This invention relates to a circuit breaker. More particularly, it is an object of the invention to provide a circuit breaker which offers enhanced current-limiting performance and interrupting performance during the tripping of the breaker.

In prior-art circuit breakers, it has been common practice to shift the arc into an arc extinguisher or to raise the separating speed of the contacts in order to quickly extinguish an electric arc struck across the gap between a pair of contacts during the interrupting operation. Such circuit breakers, however, have had the disadvantage that the foot of the arc struck across the gap between the contacts expands to fall onto the contactor conductors on which the contacts are mounted, with the result that the arc voltage, which relates to the extinction of the arc, lowers.

SUMMARY OF THE INVENTION

This invention consists in that the foot of an electric arc struck across a gap between contacts has its size and position restrained from expansion, thereby to attain a high arc voltage and enhance the current-limiting performance of the circuit breaker and also to smooth the run of the arc and enhance the interrupting performance of the circuit breaker. More specifically, this invention pertains to a circuit breaker in which the contactors of the circuit breaker for making and breaking an electric circuit are provided with arc shields of a high resistivity material in a manner so as to surround the contacts thereof, and are formed with arc runways of a higher conductivity than the arc shields and of a predetermined width and direction provided in a manner so as to adjoin to the contacts.

BRIEF DESCRIPTION OF THE DRAWINGS

In the drawings, like symbols denote like or corresponding parts.

DESCRIPTION OF THE PREFERRED EMBODIMENTS

Figure 1A:
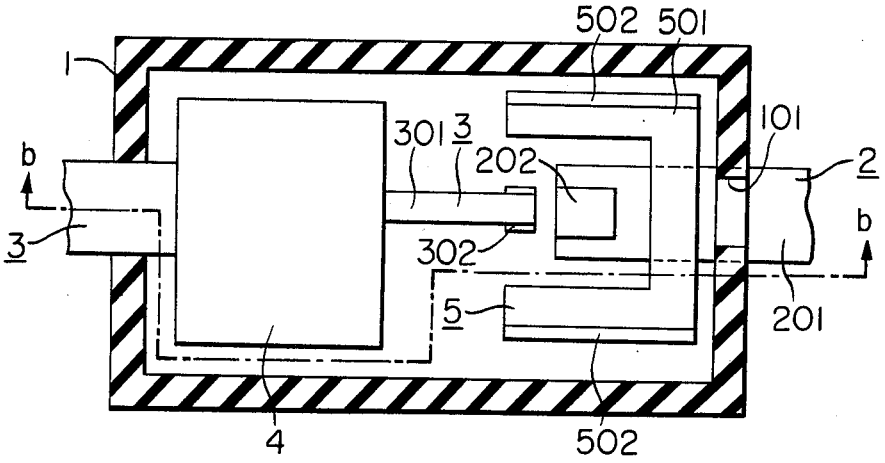
FIG. 1*a* is a sectional plan view of a conventional circuit breaker to which this invention is applicable.

A conventional circuit breaker to which this invention is applicable will be described with reference to FIGS. 1*a*, 1*b* and 1*c*.

An enclosure 1 is made of an insulating material, forming the housing for a switching device, and is provided with an exhaust port 101. A stationary contactor 2 housed in the enclosure 1 comprises a stationary rigid conductor 201 which is rigidly fixed to the enclosure 1, and a stationary-side contact 202 which is mounted on one end of the stationary rigid conductor 201. A movable contactor 3 which is adapted to engage the stationary contactor 2 comprises a movable rigid conductor 301 which makes or breaks contact with the stationary rigid conductor 201, and a movable-side contact 302 which is mounted on one end of the movable rigid conductor 301 in opposition to the stationary-side contact 202. An operating mechanism 4 operates to move the movable contactor 3 in or out of contact with the stationary contactor. An arc-extinguishing plate assembly 5 functions to extinguish an electric arc A struck upon the separation of the movable-side contact 302 from the stationary-side contact 202, and it is so constructed that a plurality of arc-extinguishing plates 501 are supported by frame plates 502. The arc-extinguishing plates 501 are usually formed of a magnetic material such as iron.

Figure 1B:
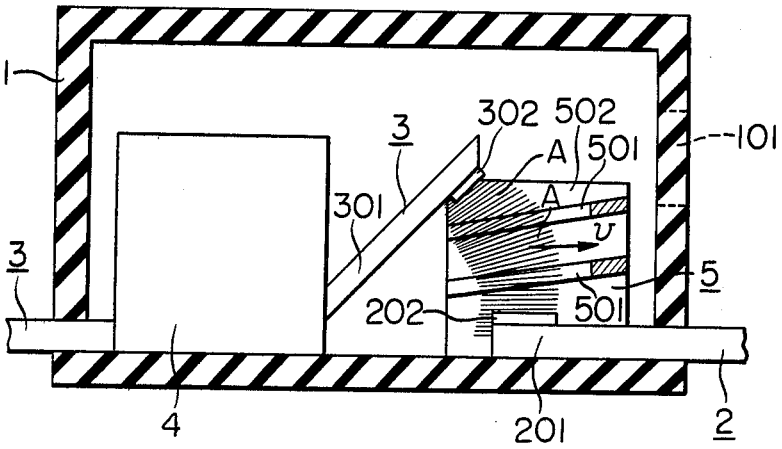
FIG. 1*b* is a sectional side view of the circuit breaker of FIG. 1*a* taken along the dot-and-dash line b—b.
Figure 1C:
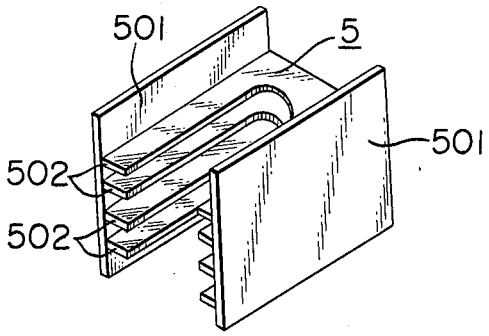
FIG. 1*c* is a perspective view of an arc-extinguishing plate assembly which is disposed in the circuit breaker of FIG. 1*a;*

Although, for the sake of simplicity of illustration, the arc-extinguishing plates 501 are illustrated as numbering two and four in FIGS. 1*b* and 1*c* respectively, it is to be understood that actually the number of arc-extinguishing plates 501 in the arc-extinguishing plate assembles 5 may number as many as, for example, ten plates.

The operating mechanism 4 and the arc-extinguishing plate assembly 5 are well known in the art, and are described, for example, in U.S. Pat. No. 3,599,130, "Circuit Interruptor," issued to W. Murai et al., Aug. 10, 1971. As apparent from the named patent, the operating mechanism includes a reset mechanism.

Assuming now that the movable-side contact 302 and the stationary-side contact 202 are closed, current flows from a power supply side onto a load side along a path from the stationary rigid conductor 201 to the stationary-side contact 202 to the movable-side contact 302 to the movable rigid conductor 301. When, in this state, a high current such as a short-circuit current flows through the circuit, the operating mechanism 4 operates to separate the movable-site contact 302 from the stationary-side contact 202. At this time, an arc A appears across the gap between the stationary-side contact 202 and the movable-side contact 302, and an arc voltage develops thereacross. The arc voltage rises as the distance of separation of the movable-side contact 302 from the stationary-side contact 202 increases. In addition, since the arc-extinguishing plates 501 are made of a magnetic material and have a reluctivity much lower than that of the surrounding space, a magnetic flux induced by the current of the arc A is attracted in the direction v (FIG. 1*b*) of the arc-extinguishing plates 501. Accordingly, the arc A is drawn toward the arc-extinguishing plates 5 and is stretched, whereby the are voltage rises even further.

As a means for driving the arc toward the arc-extinguishing plate assembly 5, a method utilizing an air current is also well known, in addition to the above method utilizing a magnetic field. More specifically, the arc is driven by the air current which is created when the air in the enclosure 1 is raised in temperature and pressure by the energy of the arc A and is discharged through the exhaust port 101. As a means for driving the arc utilizing a magnetic field, in addition to the above described method employing arc-extinguishing plates 501, also well known are a method employing a blowout coil, a blowout magnet, or a permanent magnet; a method utilizing a parallel current which flows in the reverse direction across the stationary rigid conductor 201 and the movable rigid conductor 301, and so on.

In the manner described above, the arc current reaches the current zero point to extinguish the arc A, so that the interruption is completed. Where the power supply is a D.C. power supply, an arc voltage greater than the supply voltage is generated, whereby a current limiting action is effected and the current zero point is forcibly established. With a D.C. power supply, accordingly, a phenomenon similar to that in the case of the foregoing A.C. current zero point occurs. During the interrupting operation thus far described, large quantities of energy are generated across the gap between the movable-side contact 302 and the stationary-side contact 202 in a short space of time of the order of several milliseconds, by the arc A. In consequence, the temperature of the gas within the enclosure 1 rises abruptly, as does the pressure thereof, and the high temperature and pressure gas is emitted into the atmosphere through the exhaust port 101.

The circuit breaker performs the interrupting operation as described above. In this case, the operations of the stationary-side contact 202 and the movable-side contact 302 can be analyzed as follows. In general, the arc resistance R (Ω) is given by the following expression:

$$R=\rho(l/S)$$

where $\rho$: arc resistivity (Ω·cm)

l: arc length (cm)

S: arc sectional area ($cm^2$)

In general, in short arc A with a high current of at least several kA and an arc length l of at most 50 mm, the arc space is occupied by particles of metal from the rigid conductors on which the arc has its foot. Moreover, the emission of metal particles from the rigid conductors occurs orthogonally to the rigid conductor surfaces. At the time of the emission, the metal particles have a temperature close to the boiling point of the metal used in the rigid conductors. When injected into the arc space, the metal particles possess a conductivity due to the electrical energy of the arc and they are also further raised in temperature by the arc, and flow away from the rigid conductors at high speed while expanding in a direction conforming with the pressure distribution in the arc space. The arc resistivity $\rho$ and the arc sectional area S in the arc space are determined by the quantity of metal particles produced and the direction of emission thereof. Accordingly, the arc voltage is determined by the behaviour of such metal particles.

Figure 2:
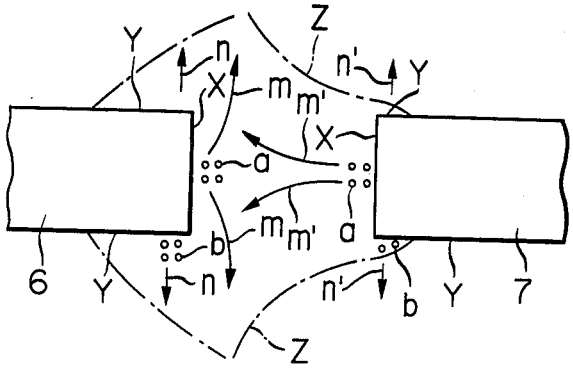
FIG. 2 is a model diagram showing the behaviour of an electric arc which is struck across the gap between the contacts of the circuit breaker of FIG. 1*a;*

FIG. 2 is a model diagram to illustrate the behaviour of the metal particles. Referring to the figure, a pair of rigid conductors 6 and 7 are ordinary conductors in the form of mutually opposed metallic cylinders. The rigid conductor 6 is an anode, while the rigid conductor 7 is a cathode. The surfaces X of the respective rigid conductors 6 and 7 are opposing surfaces which become contact surfaces when the rigid conductors 6 and 7 come into contact, and the surfaces Y of the respective rigid conductors 6 and 7 are the surface of the rigid conductors other than the surfaces X, the opposing contact surfaces. The description of the behaviour of the metal particles to be given below also applies similarly to a case where the surfaces X are formed of the contact members. A contour Z indicated by a dot-and-dash line in the figure is the envelope of the arc A struck across the gap between the rigid conductors 6 and 7. Further, metal particles a and metal particles b are typically representative of the metal particles which are respectively emitted from the surfaces X and Y of the conductors 6 and 7 by vaporization etc. The directions of emission of the metal particles a and b are the directions of the Flow lines indicated by arrows m, m' and n, n', respectively.

Such metal particles a and b emitted from the rigid conductors 6 and 7 have their temperature raised by the energy of the arc space, from approximately 3,000° C., the boiling point of the metal of the rigid conductors, to a temperature at which the metal particles bear conductivity, i.e., at least 8,000° C., or to the even higher temperature of aproximately 20,000° C. As the temperature raises, the metal particles take energy out of the arc space and thus lower the temperature of the arc space, resulting in increased arc resistance R. The quantity of energy taken from the arc space by the metal particles a and b increases with the rise in the temperature of the metal particles. In turn, the rise in the temperature is determined by the positions and emission paths of the metal particles a and b emitted from the rigid conductors 6 and 7. Further, the paths of the metal particles a and b emitted from the rigid conductors 6 and 7 are determined by the pressure distribution in the arc space. The pressure in the arc space is determined by the mutual relationship between the pinch force of the current itself and the thermal expansion of the metal particles a and b. The pinch force is a quantity which is substantially determined by the current density. In other words, it is determined by the size of the foot of the arc A on the rigid conductors 6 and 7. In general, the metal particles a and b may be considered to fly in the space determined by the pinch force while thermally expanding. It is also known that, in a case where the size of the foot of the arc A on the rigid conductors 6 and 7 is not limited, the metal particles a blow unidirectionally from one rigid conductor 7 to the other rigid conductor 6 in the form of vapor jet. When, in this manner, the metal particles a blow unidirectionally from one rigid conductor 7 toward the other rigid conductor 6, the metal particles a to be injected into the positive column of the arc A are supplied substantially from only the rigid conductor on one side 7. FIG. 2 illustrates by way of example a case where the metal particles blow strongly from the cathode to the anode, but they may also blow in the opposite direction.

The above phenomenon will now be described in greater detail. In FIG. 2, it is supposed that the blowing, for whatever reason, is unidirectional from the rigid conductor 7 toward the rigid conductor 6. The metal particles a starting from the surfaces X being the opposing contact surfaces of the rigid conductors 6 and 7 tend to fly orthogonally to the rigid conductor surfaces in other words, toward the positive column of the arc. At this time, a metal particle a which begins its flight from the contact surface X of one rigid conductor 7 is injected into the positive column by pressure caused by the pinch force. In contrast, a metal particle a which begins its flight from the contact surface X of the other rigid conductor 6 is pushed by the particle stream in the positive column and is ejected outside the contact surface X, immediately being forced out of the system without entering the positive column. In this manner, the flights of the metal particle a emitted from the rigid conductor 6 and of the metal particle a emitted from the rigid conductor 7 are different, as indicated by the flow lines of the arrows m and m' in FIG. 2. As stated before, this is based on the difference between the pressures caused by the pinch forces at the rigid conductor surface. Thus, the unidirectional blowing from the rigid conductor 7 heats the rigid conductor 6 on the blown side and expands the foot (anode spot in some cases, and cathode spot in others) of the arc on the surface of the rigid conductor 6 from the front surface X thereof to the other surface thereof. In consequence, the current density on the surface of the conductor 6 lowers, as does the pressure of the arc. Accordingly, the unidirectional blowing from the rigid conductor 7 is increasingly intensified. The discrepancy in the flight paths of the metal particles a emitted from the respective rigid conductors 6 and 7 as has thus occurred results in a discrepancy in the quantities of energy that the particles of both the conductors take from the arc space. More specifically, a metal particle a flown from the contact surface X of the rigid conductor 7 is able to absorb substantial energy from the positive column, whereas a metal particle a flown from the contact surface X of the rigid conductor 6 is not, and so it is ejected out of the system without effectively cooling the arc A. On the other hand, metal particles b emitted from the surfaces Y of the respective rigid conductors 6 and 7 spread transversely as indicated by the flow lines of the arrows n and n' in the figure. Therefore, they do not deprive the arc A of substantial heat. Moreover, they increase the arc sectional area S, resulting in lowered arc resistance R of the arc A.

In this manner, in the instance of blowing from one rigid conductor 7, the efficiency of the cooling of the positive column by the metal particles a from the other rigid conductor 6 worsens. In addition, the metal particles b appearing from the surfaces Y of both the rigid conductors 6 and 7, being those surfaces other than the opposing contact surfaces, do not contribute to the cooling of the positive column at all and may even lower the arc resistance R by increasing the arc sectional area S. Accordingly, the presence of the unidirectional blowing of the metal particles from one rigid conductor to the other is impedimental to raising the arc voltage and renders it impossible to enhance the current-limiting performance during tripping.

There are, however, several disadvantages, in that, in general, the stationary contactor and the movable contactor used in conventional circuit breakers have large opposing surface areas, similar to the conductors of the model of FIG. 2, making it impossible to limit the size of the foot of the struck arc. Moreover, the contactors have exposed surfaces such as peripheral surfaces in addition to the opposing surfaces, so that, as explained with reference to FIG. 2, the position and size of the foot (anode spot or cathode spot) of the arc appearing on the surfaces of the two conductors cannot be limited. Furthermore, the unidirectional blowing of the metal particles a from one contactor to the other occurs, with the result that the arc sectional area increases as explained with reference to FIG. 2, such that the current-limting performance during tripping cannot be enhanced, as stated above.

As apparent from the foregoing, in order to enhance the current-limiting performance of a circuit breaker, the arc voltage needs to be raised, and to this end, the metal particles appearing in the foot of the arc need to be effectively injected into the positive column from both electrodes. The force which injects the metal particles into the positive column is the pressure based on the pinch force arising in the foot of the arc, and the pinch force changes greatly in accordance with the size of the foot of the arc on the contactors, or with the current density. It is accordingly possible to control the pinch force. In conventional contactors, the area of the surfaces X of the conductors is large, which effectively prevents a limitation of the size of the foot of the arc. When the opposing contact surfaces X of both the contactors are made sufficiently small, the density of current on the contact surfaces X rises substantially, increasing the pinch force. Accordingly, metal particles are injected from both sides into the positive column, unlike in the prior-art circuit breaker, so that the arc voltage becomes higher than in the prior art. With this measure alone, however, the spread of the foot of the arc to parts other than the contact surfaces X or to the surfaces Y cannot be restrained, and the current density on the contact surfaces X decreases by a component corresponding to the spread of the foot of the arc to the surfaces Y, so that the metal particle injection pressure lowers. With the contactors of the prior art, accordingly, the cooling effect on the positive column by the injection of metal particles is not the maximum possible.

Further, in the contactors of the prior art, the spread of the foot of the arc to the surface Y leads to the disadvantage that the foot of the arc is liable to spread directly to the interfacing point between the contact and the conductor which is often set on the surface Y and a joint member of a low fusing point may be melted by the heat of the arc making the contact liable to fall off.

It is an object of this invention to provide a circuit breaker which provides good current-limiting performance in the interruption of excess currents such as accompany electric faults, and which also provides good performance in the interruption of ordinary overcurrents, such as occur in the case of an overload. With a circuit breaker according to this invention, these and other objects can be achieved by providing arc shields of a high resistivity material, on the rigid conductors of the contactors, in a manner to surround the contacts so as to leave contact surfaces of a predetermined limited area, the arc shields additionally being provided with slits of a predetermined width and direction adjacent to the contacts, the slits being formed with arc runways which are higher in conductivity than the arc shields. As the high resistivity material for the arc shields organic or inorganic insulators, as well as high resistivity alloys or metals such as copper-nickel, copper-manganese, manganese, iron-carbon, iron-nickel and iron-chromium, may be used. It is also possible to use iron of which the resistivity increases abruptly with temperature.

Hereinbelow, an embodiment of this invention will be described with reference to FIG. 3, FIGS. 4*a*–4*c* and FIGS. 5*a*–5*c*.

Figure 3:
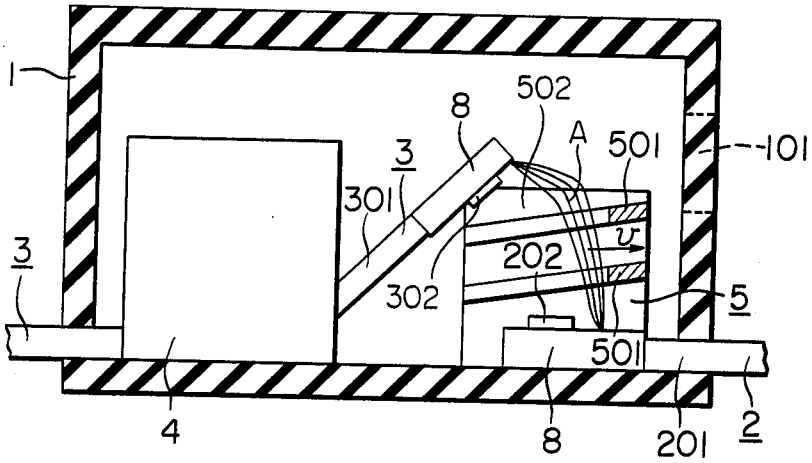
FIG. 3 is a sectional side view of a circuit breaker which is equipped with a stationary contactor and a movable contactor according to this invention.

FIG. 3 is a sectional side view of an embodiment of this invention. Parts of the circuit breaker other than the stationary contactor 2 and the movable contactor 3 are constructed similarly to the corresponding parts of the circuit breaker of the prior art shown in FIGS. 1*a*, 1*b* and 1*c*, and so description thereof will not be repeated. In the following, the geometries of the stationary contactor 2 and the movable contactor 3 of the circuit breaker in FIG. 3 2ill be described in detail with reference to FIGS. 4*a*–4*c* and FIGS. 5*a*–5*c*. The dimensions to be mentioned hereinbelow relate to a circuit breaker in which the rated current is 100 A.

Figure 4A:
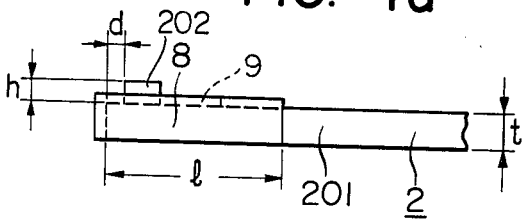
FIG. 4*a* is a side view of the stationary contactor in the circuit breaker of FIG. 3.
Figure 4C:
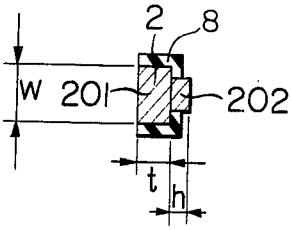
FIG. 4*c* is a sectional view of the stationary contactor of FIG. 4*a* taken along the dot-and-dash line c—c in FIG. 4*b;*
Figure 4B:
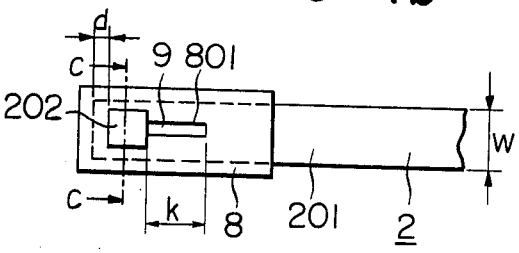
FIG. 4*b* is a plan view of the stationary contactor of FIG. 4*a;*

As particularly illustrated in FIGS. 4*a*–4*c*, the stationary contactor 2 is constructed of a stationary rigid conductor 201, an arc shield 8 having a slit 801, and a stationary-side contact 202. The rod-shaped stationary rigid conductor 201 is made of an electrically conductive material, such as copper. In the described embodiment, the width w is 8 mm, while the thickness t is 4 mm. The lower surface of the stationary rigid conductor 201 is fastened to the enclosure 1. The stationary-side contact 202 is made of a silver alloy which is also electrically conductive, and is formed in the shape of a rectangular block with a square base of 4.5 mm sides and a height of 3 mm. As shown in FIGS. 4*a*–4*c*, the bottom surface of the stationary-side contact 202 is fastened to the top surface of the stationary rigid conductor 201 near the fore end thereof. The silver alloy of the contact material may contain tungsten carbide (WC) or iridium. The distance d between one side of the bottom of the stationary-side contact 202 closer to the fore end of the stationary rigid conductor 201 and the fore end face of the stationary rigid conductor 201 is set at approximately 1.5 mm. The arc shield 8 is made of a high resistivity material, such as a phenol resin or a ceramic, and apart from the part thereof corresponding to the slit 801, it covers the side surfaces and upper surface of the stationary rigid conductor 201 in the vicinity of the stationary-side contact 202. In addition to materials such as the aforementioned phenol resin or a ceramic, the arc shield 8, may equally be constructed of a synthetic resin such as a polyester resin, drill resin, PPS (polyphenyl sulfite) resin, PBT (polybutylene terephthalate) resin, polyhydroxybenzylene resin and C-FRP (carbon fiber reinforced plastic) resin, a boron nitride, or a vulcanized fiber, etc. For a circuit breaker of low rated current, even paper may be used. By way of example, the arc shield 8 covers the stationary rigid conductor 201 to a thickness of approximately 1.5 mm and to a distance l of 23 mm measured from the fore end face of the stationary rigid conductor. The bottom of the stationary rigid conductor 201, however, is secured to the enclosure 1, and so it does not need to be covered by the arc shield 8. The slit 801 extends from the side surface of the stationary-side contact 202 remote from the fore end of the stationary rigid conductor 201, in the direction extending away from the fore end of the stationary rigid conductor 201, and thus it exposes a portion 9 of the upper surface of the stationary rigid conductor 201. The upper surface portion 9 of the stationary rigid conductor 201 thus exposed in the slit 801 forming an arc runway. By way of example, the slit 801 may have a width of 2 mm and a length (k) of 10 mm. Since, as stated above, the height h of the stationary-side contact 202 is about 3 mm and the thickness of the arc shield 8 is about 1.5 mm, the stationary-side contact 202 protrudes about 1.5 mm beyond the surface of the arc shield 8.

Figure 5A:
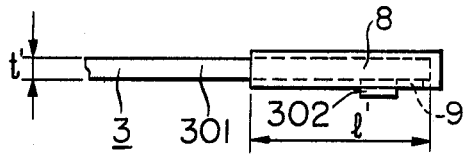
FIG. 5*a* is a side view of the movable contactor in the circuit breaker of FIG. 3.
Figure 5B:
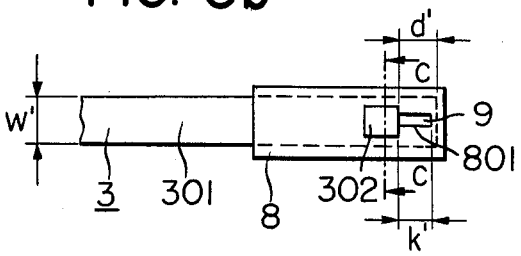
FIG. 5*b* is a bottom view of the movable contactor of FIG. 5*a;*
Figure 5C:
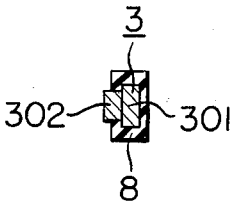
FIG. 5*c* is a sectional view of the movable contactor of FIG. 5*a* taken along the dot-and-dash line c—c in FIG. 5*b;*

As particularly illustrated in FIGS. 5*a*–5*c*, the movable contactor 3 is constructed substantially similarly to the stationary contactor 2, the movable rigid conductor 301 being similarly made of, for example, copper, with a width w′ of 8 mm, and a thickness t′ of 3.2 mm. The movable-side contact 302 is made of an electrically conductive silver alloy the same as or similar to that used in the stationary-side contact 202, and it has substantially the same dimensions as the stationary-side contact 202. The movable-side contact 302 has its upper surface fastened to the lower surface of the movable-rigid conductor 301, and the distance d′ from the fore end of the movable rigid conductor 301 to the side of the upper surface of the movable-side contact 301 nearest the same is approximately 8.5 mm. Apart from a portion thereof corresponding to a slit 801, the surface of the movable rigid conductor 301 adjacent to the movable-side contact 302 is covered by an arc shield 8. The arc shield 8 covers the surface of the movable rigid conductor 301 to a thickness of approximately 1.5 mm and to a distance l of, for example, 23 mm from the fore end face of the movable rigid conductor 301. The slit 801 has a width of 2 mm and a length (d′) of 6 mm. The portion 9 of the surface of the movable rigid conductor 301 exposed in the slit 801 forms an arc runway on the movable contactor 3 side.

Figure 6:
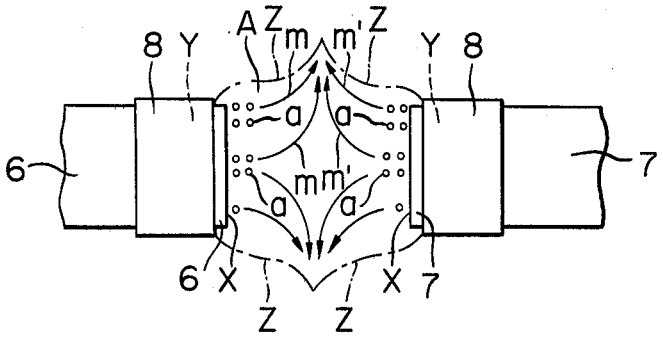
FIG. 6 is a model diagram showing the behaviour of an electric arc which is struck across the gap between the contacts of the circuit breaker of FIG. 3.

FIG. 6 is an explanatory diagram showing as a model a phenomenon which occurs across the gap between the stationary rigid conductor 201 and the movable rigid conductor 301.

Referring to FIG. 6, a conductor 6 in the shape of a metallic cylinder corresponds to the stationary rigid conductor 201 shown in FIGS. 1*a* and 1*b*, while a conductor 7 in the shape of a metallic cylinder corresponds to the movable rigid conductor 301. The respective conductors 6 and 7 are covered by arc shields 8 of a material of high resistivity, except in an arc of the surfaces X being the opposing surfaces of the contacts and the immediate vicinities thereof. That is, the surfaces Y being the peripheral surfaces of the conductors other than the opposing surfaces X are substantially covered by the arc shield 8. Accordingly, the metal particles b which were emitted from the surfaces Y in the prior art as shown in FIG. 2 are not emitted. Even when the surfaces X are constructed from the contact members, the metal particle behaviour is substantially similar to that to be described below. The contour Z of the arc and arrows m and m' indicative of the flight of the metal particles a emitted from the conductor surfaces are identical to those explained with reference to FIG. 2.

Since, in the present case, the surfaces Y are covered by the arc shields 8, no metal particles are emitted therefrom, and so the metal particles emitted are only those metal particles a that come from the surfaces X of the conductors 6 and 7.

Further, since the size of the foot (anode point or cathode point) of the arc on the conductors 6 and 7 is limited, it does not spread. Accordingly, abrupt lowering of the pressure on the conductor surfaces attributable to spreading of the foot of the arc does not occur, nor does the attendant phenomenon in which metal particles from the surfaces Y are ejected out of the system at low temperature, so that the pressure on the conductor surfaces corresponding to the limited size is reliably obtained. Thus, the metal particles a from the opposing surfaces X of the conductors 6 and 7 are reliably injected into the positive column portion, and efficient cooling is achieved.

Therefore, the arc sectional area S is substantially contracted when compared with the conductors in the prior art illustrated in FIG. 2. Moreover, with an equal current, the current density is higher than in the prior-art device described with reference to FIG. 2, so that the quantity of metal particles a emitted from the surfaces X increases to raise the quantity of energy which the metal particles take from the arc space. As a result, the arc space is more effectively cooled, and the arc resistivity $\rho$ of the arc space rises due to the temperature fall.

As thus far described, compared with the prior art illustrated in FIG. 2, the arc sectional area S is significantly contracted and the arc resistivity $\rho$ is raised, so the arc resistance R also increases. Accordingly, for an identical current value, the arc voltage is much greater, enhancing the current-limiting performance.

As illustrated in detail in FIGS. 4*a*–4*c* and FIGS. 5*a*–5*c*, the arc shields 8 provided in the circuit breaker according to this invention are formed with an arc runway 9 of a predetermined direction and width provided in a manner so as to adjoin to the contact 202 or 302. The arc runway 9 is made higher in conductivity than the arc shield. As will be discussed later, running of the arc is facilitated if the arc struck across the gap between the contacts when interrupting an overload current of about 6 times the circuit's rated current, is guided towards the arc-extinguishing plates. In order to prevent the foot of the arc from spreading, the arc runway 9 is limited to a precetermined width.

More specifically, with a rated current of the electric circuit of 100 A, an excess current amounting to, e.g., 5000 A or more might flow in the case of, e.g., a short-circuit fault in the electric circuit in which the circuit breaker is installed, while an overcurrent of about 600 A or below might flow in the case of an overload of the electric circuit. Regarding this excess current, in order to prevent any damage to the electrical equipment connected in the electric circuit, it is necessary that the arc voltage be raised quickly to satisfactorily execute the current-limiting operation as described above in detail. Accordingly, steps must be taken to prevent the foot of the arc from spreading. On the other hand, with an overcurrent of the magnitude that flows at the time of an overload, means must be provided to suitably extinguish the arc. The transfer of the arc is facilitated when, in view of such points, the arc runway is limited to a predetermined width of, e.g., 2 mm and the foot of the arc does not spread at the time of an excess current, the current value being of the same order as an overcurrent.

To sum up, in the circuit breaker of FIGS. 3 to 5*c* according to this invention, the surfaces of the rigid conductors 201 and 301 in the vicinities of the stationary-side contact 202 and movable-side contact 302 are covered by the arc shield 8, so that even if a large current of, e.g., 5000 A or 10000 A flows, the foot of the arc A struck across the gap between the contacts 202 and 302 is confined to those surfaces of the stationary-side contact 202 and movable-side contact 302 which are not covered by the arc shields 8. Accordingly, the arc voltage of the arc A rises to achieve effective current limitation. In the circuit breaker of FIGS. 3 to 5*c*, the widths of the slits 801 cut in the arc shields 8 are about 2 mm, which is sufficiently smaller than the widths of the contacts 202 and 302, so that the foot of an arc A with a large current vertually does not enter the arc runways 9. This is founded in the two reasons that the area of the foot of the arc tends to increase substantially in proportion to the arc current, and that the arc A tends to become round due to the pinch force acting on the arc A. The area of the foot of the arc A in the case where the foot of the arc is not purposedly confined is substantially proportional to the value of the arc current. Experiments have revealed that the area is about 1 $mm^2$ with an arc current value of 150 A. Accordingly, when the current value of the arc A has declined from a large value to approximately 600 A, the arc A is drawn by the arc-extinguishing plates 501 and the foot of the arc A is moved in the direction v of the arc-extinguishing plates 501 along the arc runways 9 on the stationary and movable contactors 2 and 3. As a result, the arc A is further stretched, whereupon it comes into contact with the arc-extinguishing plates 501 to be quickly cooled and extinguished. Also with a comparatively low overcurrent of or below about 600 A flowing through the circuit breaker, the arc A runs toward the arc-extinguishing plates 501 along the arc runways 9 and is extinguished in the same manner as described above.

Although, in the above description, the arc driving means for moving the arc A has been arc-extinguishing plates 501, other expedient arc driving means, such as an air current, etc. are well known as stated in connection with the circuit breaker of FIGS. 1*a*–1*c*, and may alternatively be used.

Figure 7:
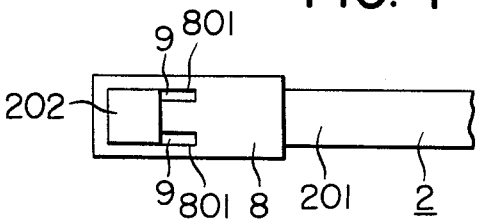
FIG. 7 is a view similar to FIG. 4*b*, but shows a modified embodiment of the stationary contactor of FIG. 4*b;*

Although, in the embodiment of FIGS. 3 to 5*c*, one arc runway 9 is provided on each of the stationary contactor 2 and the movable contactor 3, a plurality of runways may be provided on each contactor. FIG. 7 is a plan view of a stationary contactor 2 provided by way of example with two arc runways 9. The stationary contactor 2 in FIG. 7 differs from the stationary contactor 2 in FIGS. 4a–4c in that the arc shield 8 is provided with two slits 801 and that the surface parts of the stationary rigid conductor 201 exposed by the two slits 801 form the two arc runways 9. Although the length of the slits 801 is equal to that in the case of the stationary contactor in FIGS. 4a–4c, the width thereof is set at about 1 mm in the case of a circuit breaker rated at 100 A. Needless to say, the movable contactor can be similarly provided with two arc runways.

Figure 8:
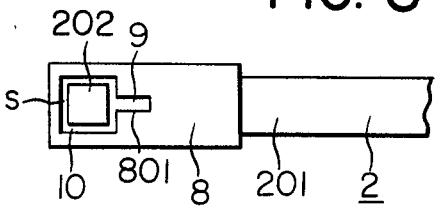
FIG. 8 is also a view similar to FIG. 4*b*, but shows another modification of the stationary contactor of FIG. 4*b;*

In the embodiment of FIGS. 3–5c, substantially no clearance is provided between the contact and the arc shield. However, as shown in the embodiment of FIG. 8, a spacing s about 1 mm wide may be provided around the contact in order to prevent burnout and peeling of the arc shield due to high temperatures in the contact.

The arc shield may also be constructed as a flat plate, as will be described later. Such construction is fully effective in suppressing the spread of the foot of the arc and in restricting the size of the foot of the arc.

Figure 10:
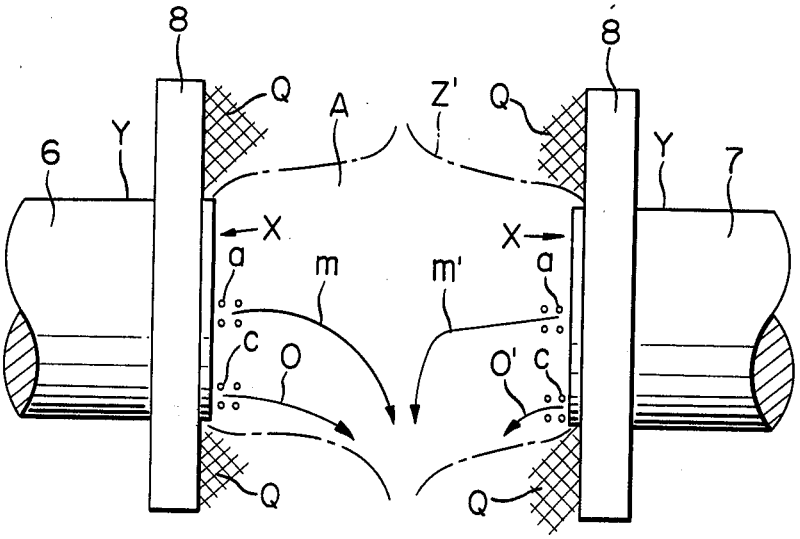
FIG. 10 is a model diagram showing the behaviour of an electric arc which is struck across the gap between the contacts of the stationary contactor and the movable contactor in FIGS. 9*a* and 9*b;*

Before describing embodiments with such construction, the effect of the construction will be explained with reference to FIG. 10. In the figure, a pair of conductors 6 and 7 are of the same form as those in FIG. 2. Flat plate arc shields 8 are respectively mounted on the conductors 6 and 7, with the surfaces X, the opposing surfaces of the conductors 6 and 7 being disposed so as to protrude, and sited in a manner to oppose an electric arc A. Of course, the metal particle behaviour to be described below applies similarly even when the surfaces X are formed from the contact members themselves. Pressure values in the spaces Q cannot exceed the pressure value of the space of the arc A itself. However, much higher values are exhibited, at least in comparison with the values attained without the arc shields 8. Accordingly, the peripheral spaces Q which have the relatively high pressures caused by the arc shields 8 generate forces that suppress the spread of the space of the arc A and confine the arc A to a small area. This results in fining the confining into the arc space of the flow lines m, m', o and o' of metal particles a and c emitted from the surfaces X being the opposing surfaces. Therefore, the metal particles a and c having been emitted from the surfaces X are effectively injected into the arc space. As a result, large quantities of metal particles a and c are effectively injected and take large quantities of energy from the arc space, thus cooling the arc space. Accordingly, the resistivity $\rho$ or the arc resistance R is significantly raised, as is the arc voltage.

Further, when the arc shields 8 are disposed near and around the contact surfaces of the stationary-side contact and the movable-side contact, namely, the surfaces X being the opposing surfaces shown in FIG. 5b, the arc A is prevented from moving to the surfaces Y being the other surfaces of the conductor and also the size of the foot of the arc A is limited. Thus, the emission of the metal particles a and c is concentrated on the surfaces X, and the arc sectional area is contracted, so that the effective injection of the metal particles a and c into the arc space is further promoted. Accordingly, the cooling of the arc space, the rise of the arc resistivity $\rho$ and the rise of the arc resistance R are further improved, and the arc voltage can be further raised.

Figure 9A:
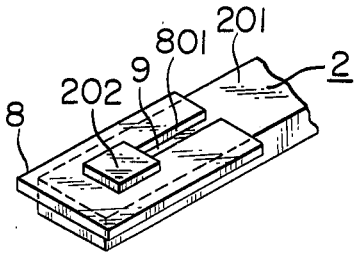
FIG. 9*a* is a perspective view of a stationary contactor provided with a plate-form arc shield according to this invention.
Figure 9B:
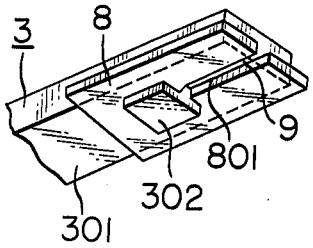
FIG. 9*b* is a perspective view of a movable contactor which pairs with the stationary contactor of FIG. 9*a;*

FIGS. 9a and 9b are perspective views of an embodiment in which a stationary contactor 2 and a movable contactor 3 are respectively provided with plate-form arc shields 8. In this embodiment, arc runways 9 adjoining contacts 202 and 302 are made open at ends thereof remote from the contacts. This has the effect of preventing any local heating and burnout of the arc-extinguishing plates attributable to termination of the arc's run from this point. The embodiment is constructed similarly to the foregoing embodiment of FIGS. 3 to 5c except that the arc shields 8 are formed as plates of a thickness of about 1.5 mm.

Figure 11A:
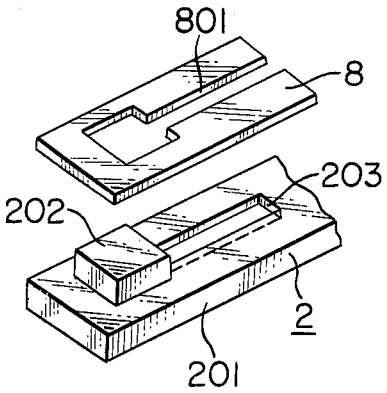
FIG. 11*a* is an exploded perspective view of a stationary contactor which has a recess or slit in a stationary conductor.
Figure 11B:
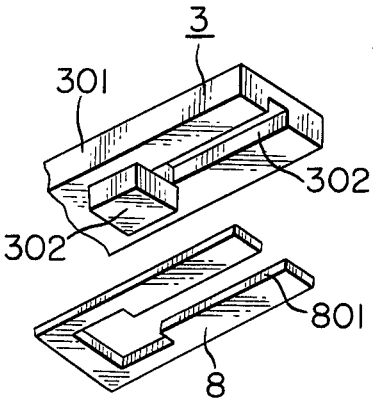
FIG. 11*b* is an exploded perspective view of a movable contactor which pairs with the stationary contactor of FIG. 11*a;*

FIGS. 11a and 11b show another embodiment. Respective conductors 201 and 301 of a stationary contactor 2 and a movable contactor 3 are provided with grooves 203 and 303 which are 2 mm wide and 1 mm deep and which correspond to the slits 801 in the arc shields. Thus, when the arc runs, the length of the arc is stretched to increase the arc resistance thus promoting the arc-extinguishing action, and allowing easier heat dissipation from the contacts.

Figure 12A:
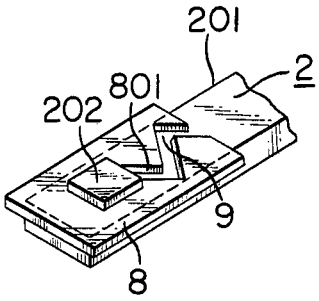
FIG. 12*a* is a perspective view of a stationary contactor which is provided with an arc shield having a zigzag slit.
Figure 12B:
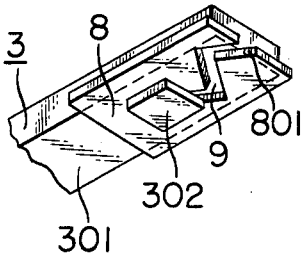
FIG 12*b* is a perspective view of a movable contactor which pairs with the stationary contactor of FIG. 12*a;*

FIGS. 12a and 12b show still another embodiment, in which the arc runways 9 are formed in a substantially zig-zag fashion in order to increase the distance of the arc's run. Thus, the arc extinction during the arc's run is made more effective. The zig-zag of the runway may be formed by a suitable combination of V-shapes or portions thereof.

In the illustrated stationary and movable contactors of the embodiment shown in FIGS. 12a and 12b, the arc runway is formed of a plurality of straight section, adjacent sections being intersected at an angle of substantially 90° C. with the first straight section adjoining the adjacent side of the contact 202 or 302, substantially centrally thereof. The peaks of the zig-zag in the illustrated embodiment are substantially within limits defined on either side by the width of the contact 202 or 302, but may extend beyond this limit, so long as the zig-zag does not go beyond the edges of the rigid conductor 201 or 301. In addition to the illustrated angular zig-zag arc runway 9, an arc runway defining a sine-wave curve or other undulating shape may equally employed in order to increase the effective length of the arc runway.

Figure 13A:
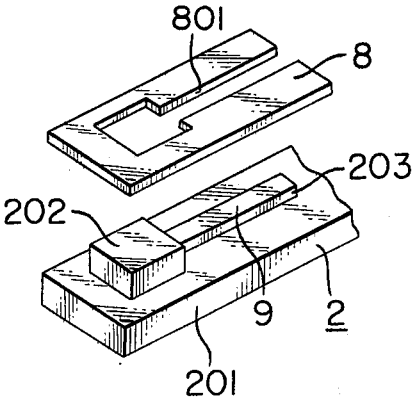
FIG. 13*a* is an exploded perspective view of a stationary contactor which is provided with an arc runway constructed so that a metal strip of a material different from the stationary conductor is fixed to the stationary conductor.
Figure 13B:
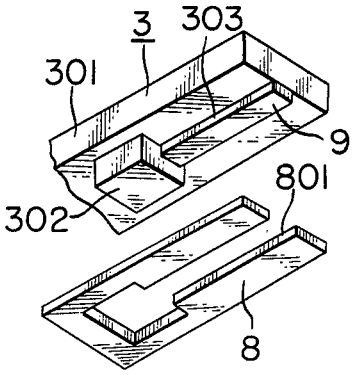
FIG. 13*b* is an exploded perspective view of a movable contactor which pairs with the stationary contactor of FIG. 13*a*.

FIGS. 13a and 13b show yet another embodiment of a stationary contactor 2 as well as a movable contactor 3. 2 mm thick strip-like members 203 and 303 with high thermal conductivity are mounted on the respective conductors 201 and 301 of the stationary and movable contactors 2 and 3 congruously with the slits 801 in the arc shields 8, the top surfaces of these members 203 and 303 serving as the arc runways 9. Other parts of the embodiment are constructed in the same manner as the corresponding members in the embodiment of FIGS. 9a and 9b. These raised arc runway members 203 and 303 of this embodiment have the effect of efficiently conducting away the heat that accumulates in the contacts 202 and 302 when they are heated by the arc struck across the gap there between.

Where the members 203 and 303 are made of a high-melting point material, of a higher melting point than the conductors of the contactors, such as, for example, tungsten, a copper-tungsten alloy, a silver-tungsten alloy, nichrome or kanthal, wearing away of the members 203 and 303 by running of the arc is minimal, even when the circuit breaker is used frequently.

Further, where a magnetic material such as iron and nickel adapted to deionize an arc plasma is used as the material for the members 203 and 303, the extinguishing effect with regard to the arc during its run is intensified.

The foregoing embodiments arc to be regarded as merely illustrative, and various modifications and improvements may be resorted to, that fall within the scope of this invention.

What is claimed is:

1. A circuit breaker comprising a pair of contactors comprising rigid conductors with contacts fastened thereto, said contactors functioning to open and close an electric circuit, an arc shield disposed on at least one of said contactors, having a resistivity higher than that of said conductors and which surrounds said contact, arc driving means to drive in a predetermined direction an electric arc struck across the gap between said pair of contactors, and an arc runway adjoining said contact provided with said arc shield and extending in said predetermined direction, and which has a resistivity lower than that of said arc shield and is narrower than the side of said contact to which it adjoins.

2. A circuit breaker as claimed in claim 1, wherein said arc shield includes a slit which extends from said contact in said predetermined direction, and the portion of the surface of said conductor exposed by said slit forms said arc runway.

3. A circuit breaker as claimed in claim 2, wherein said slit extends from said contact through an edge of said arc shield, and said arc runway opens onto that part of the conductor surface that is not covered by said arc shield.

4. A circuit breaker as claimed in claim 2, wherein said arc shield is made of a plate member which covers the surface of said conductor in the vicinity of said contact.

5. A circuit breaker as claimed in claim 2, wherein said conductor is provided with a recess corresponding to said slit, said recess forming said arc runway.

6. A circuit breaker according to claim 2, wherein said slit extends in said predetermined direction in a zig-zag manner.

7. A circuit breaker as claimed in claim 1, wherein said arc shield includes a slit which extends in said predetermined direction, and said arc runway is made of a metal strip disposed on said conductor in congruity with said slit and which has a thermal conductivity higher than that of said conductor.

8. A circuit breaker as claimed in claim 1, wherein said arc shield includes a slit which extends in said predetermined direction, and said arc runway is made of a metal strip disposed on said conductor in congruity with said slit and which has a melting point higher than that of said conductor.

9. A circuit breaker as claimed in claim 1, wherein said arc shield includes a slit which extends in said predetermined direction, and said arc runway is formed of a metal strip formed of a magnetic material which has the effect of deionizing an arc plasma, disposed on said conductor in congruity with said slit.

* * * * *